United States Patent [19]

Shu

[11] Patent Number: 4,466,485

[45] Date of Patent: Aug. 21, 1984

[54] VISCOUS OIL RECOVERY METHOD

[75] Inventor: Winston R. Shu, Dallas, Tex.

[73] Assignee: Mobil Oil Corporation, New York, N.Y.

[21] Appl. No.: 447,596

[22] Filed: Dec. 7, 1982

[51] Int. Cl.[3] ..... E21B 43/24

[52] U.S. Cl. ..... 166/272; 166/50

[58] Field of Search ..... 166/50, 263, 268, 269, 166/271, 272, 303, 308

[56] References Cited

U.S. PATENT DOCUMENTS

| | | | |
|---|---|---|---|
| 3,483,924 | 12/1969 | Blevins et al. | 166/272 |
| 3,960,214 | 6/1976 | Streigler et al. | 166/272 |
| 3,994,340 | 11/1976 | Anderson et al. | 166/50 |
| 4,007,785 | 2/1977 | Allen et al. | 166/272 |
| 4,060,129 | 11/1977 | Gomaa et al. | 166/272 |
| 4,257,650 | 3/1981 | Allen | 166/263 |
| 4,344,485 | 8/1982 | Butler | 166/271 |
| 4,372,381 | 2/1983 | McMillen | 166/263 |
| 4,398,602 | 8/1983 | Anderson | 166/263 |

*Primary Examiner*—Stephen J. Novosad

*Assistant Examiner*—William P. Neuder

*Attorney, Agent, or Firm*—Alexander J. McKillop; Michael G. Gilman; Malcolm D. Keen

[57] ABSTRACT

A subterranean, viscous oil-containing formation is penetrated by at least one injection well which extends downwardly from the earth's surface to the formation and then extends a predetermined distance through the formation in a generally horizontal direction. The horizontal section of the injection well is in fluid communication with the formation. At least one spaced apart production well penetrates the formation in fluid communication with the upper two-thirds or less of the formation. A slug of steam, about 0.35 to 0.45 pore volume, is injected into the injection well and fluids including oil are recovered from the formation via the production well. The injection well is shut-in for a predetermined period of time while continuing production of oil. Thereafter, a predetermined amount, about 0.03 to 0.10 pore volume, of hot water or low quality steam is injected into the injection well and production is continued until there is an unfavorable amount of water or steam in the fluids recovered.

10 Claims, 1 Drawing Figure

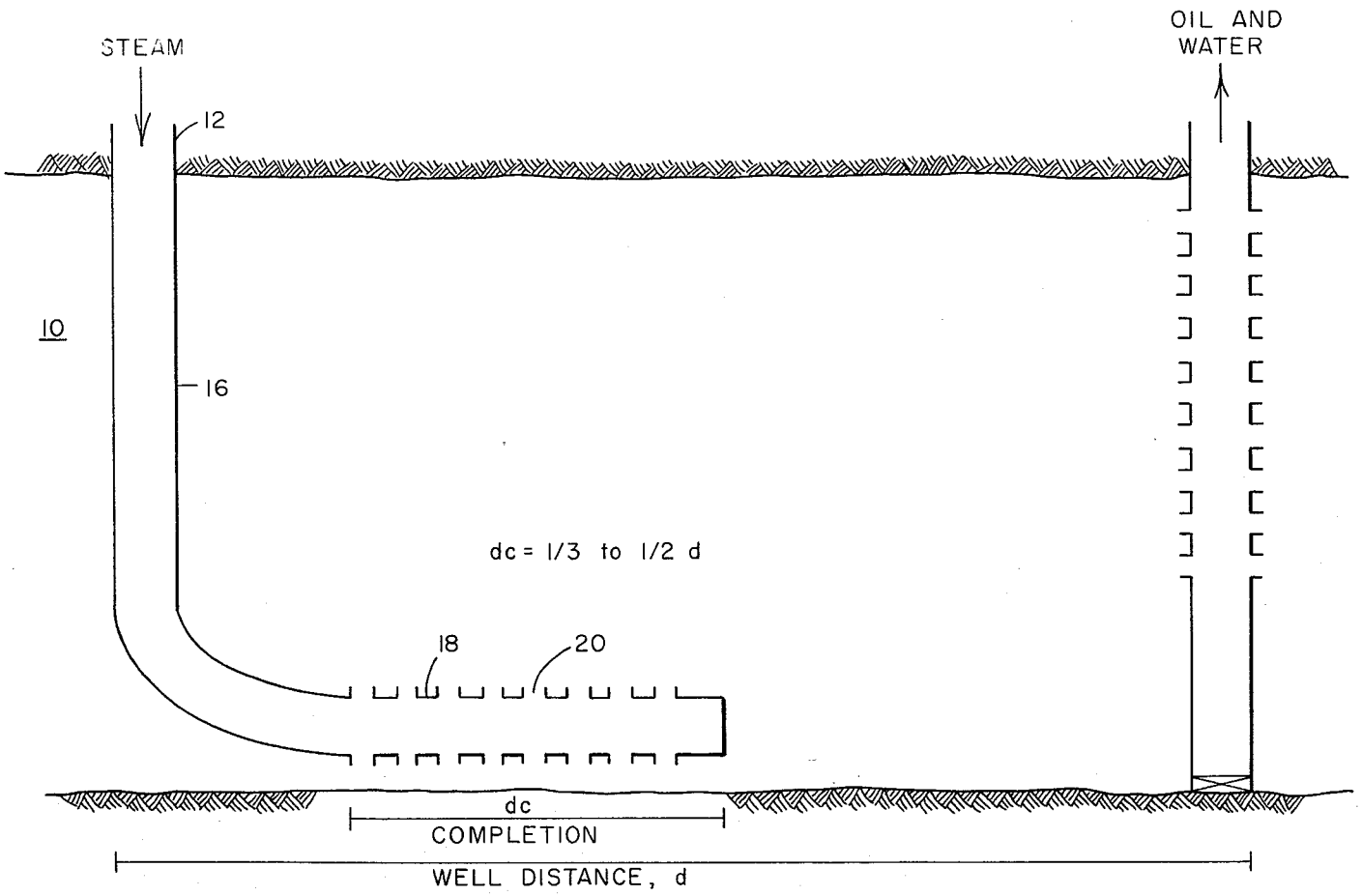
OIL AND WATER
STEAM
12
16
10
18
20
dc = 1/3 to 1/2 d
dc
COMPLETION
WELL DISTANCE, d

VISCOUS OIL RECOVERY METHOD

BACKGROUND OF THE INVENTION

1. Field of the Invention

This invention relates to a thermal process for recovering oil from a subterranean, viscous oil-containing formation. More particularly, this invention relates to a thermal method of recovering oil from a viscous oil-containing formation, especially a highly viscous tar sand deposit, employing a deviated injection well for injecting a thermal fluid into the bottom portion of the formation and a sequence of manipulative steps with steam and hot water to obtain maximum heat utilization and oil recovery from a spaced-apart production well completed in the upper portion of the formation.

2. Background of the Invention

Increasing worldwide demand for petroleum products, combined with continuously increasing prices for petroleum and products recovered therefrom, has prompted a renewed interest in the sources of hydrocarbons which are less accessible than crude oil of the Middle East and other countries. One of the largest deposits of such sources of hydrocarbons comprises tar sands and oil shale deposits found in Alberta, Canada, and in the Midwest and Western states of the United States. While the estimated deposits of hydrocarbons contained in tar sands are enormous (e.g., the estimated total of the deposits in Alberta, Canada is 250 billion barrels of synthetic crude equivalent), only a small proportion of such deposits can be recovered by currently available mining technologies (e.g., by strip mining). For example, in 1974, it was estimated that not more than about 10% of the then estimated 250 billion barrels of synthetic crude equivalent of deposits in Alberta, Canada was recoverable by the then available mining technologies. (See SYNTHETIC FUELS, March 1974, pages 3-1 through 3-14). The remaining about 90% of the deposits must be recovered by various in-situ techniques such as electrical resistance heating, steam injection and in-situ forward and reverse combustion.

Of the aforementioned in-situ recovery methods, steam flooding has been a widely-applied method for heavy oil recovery. Problems arise, however, when one attempts to apply the process to heavy oil reservoirs with very low transmissibility such as tar sand deposits. In such cases, because of the unfavorable mobility ratio, steam channelling and gravity override often result in early steam breakthrough and leave a large portion of the reservoir unswept. The key to a successful steam flooding lies in striking a good balance between the rate of displacement and the rate of heat transfer which lowers the oil viscosity to a more favorable mobility ratio.

Copending application filed July 20, 1982, Ser. No. 400,178, by Shu et al discloses a thermal method for the recovery of oil from a subterranean, viscous oil-containing formation, steam in an amount ranging from 0.3 to 0.5 pore volume and an injection rate within the range of 4.0 to 7.0 bbl/day/ac.-ft. is injected into the formation via an injection well completed in the lower 50% or less of the formation and fluids including oil are recovered via a spaced-apart production well completed in the upper 50% or less of the formation. The injection well is then shut-in for a variable time and thereafter a predetermined amount of hot water or low quality steam is injected into the formation via the injection well in an amount ranging from 0.03 to 0.10 pore volume and at an injection rate of 1 to 2.0 bbl/day/ac.-ft. The method is applied to viscous oil-containing formation in which either naturally occurring or induced communication exists between the injection well and the production well in the bottom zone of the formation. The injection well and production well are spaced apart 400 to 750 feet.

Copending application filed Nov. 12, 1981, Ser. No. 320,236, by Shu et al and assigned to a common assignee, discloses a thermal method for the recovery of oil from a subterranean, viscous oil-containing formation, wherein a predetermined amount of steam in an amount not greater than 1.0 pore volume is injected into the formation via an injection well and oil is produced from the formation via a production well. The injection well is then shut-in for a variable time to allow the injected steam to dissipate its heat throughout the formation and reduce oil viscosity while continuing production of oil. A predetermined amount of hot water or low quality steam in an amount not greater than 1.0 pore volume is injected into the formation with continued production but avoiding steam breakthrough. Thereafter, production is continued until there is an unfavorable amount of water or steam in the fluids recovered.

Applicant's copending application filed concurrently herewith, Attorney's Docket No. 2014, relates to a method for the recovery of oil from a subterranean, viscous oil-containing formation penetrated by at least one injection well which extends into the bottom of the formation and establishing a cavity in the bottom of the formation through the injection well that is not greater than 0.1 pore volume. A spaced-apart production well is completed in the upper portion thereof and oil is recovered utilizing manipulative steam flooding.

Applicant's copending application filed concurrently herewith, Attorney's Docket No. 2016, relates to a method for recovery of oil from a viscous oil-containing formation not greater than 2500 feet in depth employing a horizontal fracture formed in the lower portion of the formation through the injection well, a spaced-apart production well completed in the upper portion thereof, and manipulative steam flooding.

Accordingly, this invention provides an improved thermal system for effectively recovering oil from subterranean formations such as tar sand deposits utilizing a deviated injection well extending into the lower portion of the formation and a production well completed in the upper portion of the formation combined with manipulative steam flooding.

SUMMARY OF THE INVENTION

A subterranean, low transmissibility, viscous oil-containing formation is penetrated by at least one injection well and at least one spaced-apart production well. The injection well extends downwardly from the earth's surface to the bottom of the oil-containing formation wherein the lower portion of the well extends horizontally through the formation for a distance from about one-third to one-half of the distance between the downward portion of the injection well and the production well. The horizontal portion of the injection well is in fluid communication with the formation. The production well is completed so that it is in fluid communication with the upper two-thirds or less of the vertical thickness of the formation. A slug of steam in an amount within the range of 0.35 to 0.45 pore and at a rate of from 4.5 to 6.5 bbl/day/ac.-ft. is injected into the lower portion of the formation via the injection well and fluids including oil are recovered from the formation via said production well. Simultaneously during injection of the steam into the injection well and fluids are being produced from the production well, a solvent or steam injection-production process may be applied at the production well. This process is applied simultaneously with the steam drive process in a series of repetitious cycles throughout the entire time that the steam drive sequence is being applied and particularly in the early stages to enhance production. After the first slug of steam has been injected into the formation, the injection well is shut-in for a predetermined period of time and the recovery of fluids including oil is continued from the production well without steam breakthrough. Injection of the slug of hot water or low quality steam may be repeated for a plurality of cycles. Thereafter, a predetermined amount, preferably 0.03 to 0.10 pore volume, of hot water or low quality steam is injected into the formation via the injection well and fluids including oil are recovered from the formation via the production well. The hot water or low quality steam is injected at a rate of from 1 to 1.5 bbl/day/ac.-ft. Thereafter, production of fluids including oil is continued from the production well until the recovered fluids contain an unfavorable amount of steam or water.

BRIEF DESCRIPTION OF THE DRAWINGS

The drawing illustrates a subterranean oil-containing formation being subjected to the improved steam flooding techniques in the present invention, penetrated by a deviated injection well in fluid communication with the bottom portion of the formation and a spaced-apart production well in fluid communication with the upper portion of the formation.

DESCRIPTION OF THE PREFERRED EMBODIMENT

Referring to the drawing, a relatively thick, subterranean, low transmissibility, viscous oil-containing formation 10 is penetrated by at least one deviated injection well 12 and at least one spaced-apart production well 14. As shown in the drawing, the injection well 12 extends downwardly from the earth's surface and into the oil-containing formation 10 having a substantially vertical section 16 and a substantially horizontal section 18 extending a predetermined distance through the formation near the bottom thereof. The horizontal section 18 is provided with perforations 20 to establish fluid communication with the lower portion of the formation 10 and the horizontal section extends a distance of about one-third to one-half distance between the vertical section 16 of the injection well 12 and the production well 14. The horizontal section 18 of the injection well should be completed with a slot liner (not shown) or other sand-control means to prevent blockage of fluid flow such as disclosed in U.S. Pat. No. 4,116,275, the disclosure of which is hereby incorporated by reference. The production well 14 is perforated to establish fluid communication with the upper portion of the formation, not exceeding two-thirds of the vertical thickness of the formation.

Referring to the drawing, the first step of the process is to inject a slug of steam ranging from 0.35 to 0.45 pore volume and preferably 0.37 pore volume into the formation 10 via the injection well 12 and fluids including oil are recovered from the formation via production well 14. The steam is injected at a predetermined rate ranging from 4.5 to 6.5 bbl/day/ac.-ft. and preferably 5.0 bbl/day/ac.-ft. Because of the low transmissibility of the formation 10, initially the total fluid production rate will be much less than the injection rate and formation pressure well build up.

During the initial portion of the above-described steam injection, the production well 14 may be steam or solvent stimulated by a steam/solvent injection-production sequence or push-pull process. This sequence comprises injecting a predetermined amount of steam or solvent into the formation 10 via the production well 14 and then returning the well to production. The above sequence of steam or solvent injection followed by fluid production may be repeated for a plurality of cycles. Suitable solvents include $C_2$ to $C_{10}$ hydrocarbons including mixtures, as well as commercial mixtures such as kerosene, naphtha, natural gasoline, etc.

After the slug of steam has been injected into the formation 10 via injection well 12, the injection well is shut-in for a predetermined period of time and production is continued. This soak-period allows heat to dissipate into the formation thereby further reducing the viscosity of the oil. The high completion, upper two-thirds or less of the formation, allows a vertical growth of the steam zone originating from the low viscous finger as pressure decreases and steam rises in the formation. As the heated zone grows, the rate of production increases and the formation pressure is drawn down.

After the injection well 12 has been shut-in for a predetermined period of time and production continued but without steam breakthrough, a second slug of a heated fluid, preferably hot water or low quality steam, is injected into the formation 10 via the injection well 12 and production is continued until there is an unfavorable amount of steam or water in the fluids recovered from the formation via the production well. The quality of the stream injected is not greater than 20%. The amount of heated fluid injected is from 0.03 to 0.10 pore volume at an injection rate of 1 to 1.5 bbl/day/ac.-ft. During injection of the heated fluid, the formation will be pressurized and additional mobilized oil will be displaced through the formation 10 for recovery via the production well 14. It is preferred during this step to inject hot water as the thermal fluid because, unlike steam, it will not migrate in an upward direction toward the top of the formation but is able to appropriate heat from the steam already present in the formation and cause it to condense such that steam channeling is deterred. This extends the production time by delaying steam breakthrough at the production well thereby enhancing oil recovery. Additional slugs of hot water or low quality steam may be injected into the formation 10 via injection well 12 for a plurality of cycles.

By the term "pore volume" as used herein, is meant that volume of the portion of the formation underlying the well pattern employed as described in greater detail in U.S. Pat. No. 3,927,716 to Burdyn et al, the disclosure of which is hereby incorporated by reference.

While the invention has been described in terms of a single injection well and a single spaced apart production well, the method according to the invention may be practiced using a variety of well patterns. Any other number of wells, which may be arranged according to any patterns, may be applied in using the present method as illustrated in U.S. Pat. No. 3,927,716 to Burdyn et al. and prevents efficient sweep. If the wells are too far apart, formation communication is usually limited.

From the foregoing specification, one skilled in the art can readily ascertain the essential features of this invention and without departing from the spirit and scope thereof can adapt it to various diverse applications. It is my intention and desire that my invention by limited only by those restrictions or limitations as contained in the claims appended immediately hereinafter below.

What is claimed is:

1. A method of recovering viscous oil from a subterranean, low transmissibility, viscous oil-containing formation comprising:

(a) penetrating the formation with at least one injection well which extends downwardly from the earth's surface to the bottom of said formation and then extends a predetermined distance through said formation in a generally horizontal direction, said horizontal portion of said injection well being in fluid communication with said formation;

(b) penetrating the formation with at least one production well spaced apart from said injection well, said production well being in fluid communication with the upper two-thirds or less of the vertical thickness of the formation;

(c) injecting 0.35 to 0.45 pore volume of steam at an injection rate within the range of 4.5 to 6.5 bbl/day/ac.-ft. into the lower portion of the formation via said injection well and recovering fluids including oil from the formation via said production well;

(d) subsequently shutting in said injection well and continuing to recover fluids including oil from the formation via said production well for a predetermined period of time and recovering fluids including oil from the formation via the production well without steam breakthrough;

(e) injecting a predetermined amount of hot water or low quality steam into the formation via said injection well; and (f) continuing to recover fluids including oil from the formation via said production well until the recovered fluids contain an unfavorable amount of steam or water.

2. The method of claim 1 wherein the amount of hot water injected during step (e) is 0.03 to 0.10 pore volume and the injection rate is 1 to 1.5 bbl/day/ac.-ft.

3. The method of claim 1 wherein the low quality steam injected during step (e) is steam having a quality not greater than 20%.

4. The method of claim 1 wherein the horizontal portion of said injection well extends a distance of about one-third to one-half of the distance between the vertical portion of the injection well and said production well.

5. The method of claim 1 wherein step (e) is repeated for a plurality of cycles.

6. A method of recovering viscous oil from a subterranean, low transmissibility, viscous oil-containing formation comprising:

(a) penetrating the formation with at least one injection well which extends downwardly from the earth's surface to the bottom of said formation and then extends a predetermined distance through said formation in a generally horizontal direction, said horizontal portion of said injection well being in fluid communication with said formation;

(b) penetrating the formation with at least one production well spaced apart from said injection well, said production well being in fluid communication with the upper two-thirds or less of the vertical thickness of the formation;

(c) injecting 0.35 to 0.45 pore volume of steam at an injection rate within the range of 4.5 to 6.5 bbl/day/ac.-ft. into the lower portion of the formation via said injection well and recovering fluids including oil from the formation via said production well;

(d) simultaneously injecting a predetermined amount of steam or solvent into the formation via said production well;

(e) recovering fluid including oil from the formation via said production well;

(f) repeating steps (d) and (e) for a plurality of cycles;

(g) shutting in said injection well and continuing to recover fluids including oil from the formation via said production well for a predetermined period of time and recovering fluids including oil from the formation via the production well without steam breakthrough;

(h) injecting a predetermined amount of hot water or low quality steam into the formation via said injection well; and (i) continuing to recover fluids including oil from the formation via said production well until the recovered fluids contain an unfavorable amount of steam or water.

7. The method of claim 6 wherein the amount of hot water injected during step (h) is 0.03 to 0.10 pore volume and the injection rate is 1 to 1.5 bbl/day/ac.-ft.

8. The method of claim 6 wherein the low quality steam injected during step (h) is steam having a quality not greater than 20%.

9. The method of claim 6 wherein the horizontal portion of said injection well extends a distance of about one-third to one-half of the distance between the vertical portion of the injection well and said production well.

10. The method of claim 6 wherein step (h) is repeated for a plurality of cycles.

* * * * *